US012325104B2

(12) United States Patent
Akita et al.

(10) Patent No.: US 12,325,104 B2
(45) Date of Patent: Jun. 10, 2025

(54) GRINDING METHOD OF WORKPIECE

(71) Applicant: DISCO CORPORATION, Tokyo (JP)

(72) Inventors: Daisuke Akita, Tokyo (JP); Yoshikazu Suzuki, Tokyo (JP); Makoto Saito, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 684 days.

(21) Appl. No.: 17/450,572

(22) Filed: Oct. 12, 2021

(65) Prior Publication Data

US 2022/0134509 A1 May 5, 2022

(30) Foreign Application Priority Data

Nov. 4, 2020 (JP) ..... 2020-184622

(51) Int. Cl.
*B24B 49/08* (2006.01)
*B24B 7/04* (2006.01)
(Continued)

(52) U.S. Cl.
CPC ..... *B24B 49/08* (2013.01); *B24B 7/04* (2013.01); *B24B 41/047* (2013.01); *B24B 47/20* (2013.01);
(Continued)

(58) Field of Classification Search
CPC ..... B24B 37/005; B24B 37/042; B24B 49/18; B24B 49/183; B24B 53/017; B24B 53/02;
(Continued)

(56) References Cited

U.S. PATENT DOCUMENTS 6,672,945 B1 * 1/2004 Matsuo ..... B24B 53/001 451/72
6,783,445 B2 * 8/2004 Torii ..... B24B 53/12 451/287
(Continued)

FOREIGN PATENT DOCUMENTS

JP 2012210697 A * 11/2012 ..... B24B 1/00
JP 2012222123 A * 11/2012
(Continued)

OTHER PUBLICATIONS

Yoshiyuki S, JP-2012222123-A, Nov. 12, 2012; translation (Year: 2012).*
(Continued)

*Primary Examiner* — Makena S Markman
(74) *Attorney, Agent, or Firm* — Greer Burns & Crain Ltd.

(57) ABSTRACT

A grinding method includes a first grinding step of executing grinding feed of a rough grinding unit and grinding the workpiece to a predetermined thickness while supplying grinding water with a first grinding water amount that allows suppression of wear of grinding abrasive stones and a second grinding step of, after executing the first grinding step, promoting dressing of the grinding abrasive stones to prepare for processing of the next workpiece through executing grinding feed of the rough grinding unit and grinding the workpiece to the finished thickness while supplying the grinding water with a second grinding water amount that increases wear of the grinding abrasive stones and promotes self-sharpening through reduction relative to the first grinding water amount.

5 Claims, 5 Drawing Sheets

(51) Int. Cl.

| | |
|---|---|
| ***B24B 7/22*** | (2006.01) |
| ***B24B 41/047*** | (2006.01) |
| ***B24B 47/20*** | (2006.01) |
| ***B24B 51/00*** | (2006.01) |
| ***B24B 53/08*** | (2006.01) |
| ***B24B 57/02*** | (2006.01) |
| *B24B 27/00* | (2006.01) |

(52) U.S. Cl.
CPC ..... *B24B 51/00* (2013.01); *B24B 53/08* (2013.01); *B24B 57/02* (2013.01); *B24B 7/228* (2013.01); *B24B 27/0023* (2013.01)

(58) Field of Classification Search
CPC ..... B24B 53/013; B24B 47/25; B24B 49/08; B24B 7/04; B24B 41/047; B24B 53/08; B24B 7/228; B24B 27/0023; B24B 47/20; B24B 51/00; B24B 49/02; B24B 37/013; B24B 7/241; B24B 49/16; B24B 53/32; B24B 57/02; B24B 49/04; H01L 21/67092
USPC ..... 451/5, 11, 41
See application file for complete search history.

(56) References Cited

U.S. PATENT DOCUMENTS

| | | | | |
|---|---|---|---|---|
| 2003/0124960 | A1* | 7/2003 | Wada | B24B 53/017 257/E21.244 |
| 2015/0239089 | A1* | 8/2015 | Hirayama | B24B 57/02 451/59 |
| 2019/0308296 | A1* | 10/2019 | Kawana | B24B 37/044 |
| 2019/0314950 | A1* | 10/2019 | Inoue | H01L 22/12 |

FOREIGN PATENT DOCUMENTS

| | | | |
|---|---|---|---|
| JP | 2014124690 | A | 7/2014 |
| JP | 2015196226 | A | 11/2015 |
| JP | 2017056523 | A | 3/2017 |
| JP | 2018024041 | A | 2/2018 |

OTHER PUBLICATIONS

Atsushi A, JP-2012210697-A, Nov. 1, 2012, translation (Year: 2012).*
Search report issued in counterpart Singapore patent application No. 10202111344R, dated Mar. 10, 2023.

* cited by examiner

GRINDING METHOD OF WORKPIECE

BACKGROUND OF THE INVENTION

Field of the Invention

The present invention relates to a grinding method of a workpiece.

Description of the Related Art

A grinding apparatus that thins a workpiece such as a wafer on which semiconductor devices are formed has been used (for example, refer to Japanese Patent Laid-open No. 2018-24041 and Japanese Patent Laid-open No. 2017-56523). The above-described grinding apparatus involves a problem that, when a hard substrate of silicon carbide (SiC), sapphire, or the like is ground, it is difficult for grinding abrasive stones to bite into a workpiece particularly at the beginning of processing and the grinding load increases and the current value of a spindle is liable to rise.

Thus, in the grinding apparatus, when the water amount of grinding water is set small, wear of the grinding abrasive stones increases and self-sharpening is promoted and the grinding load is reduced. However, in the grinding apparatus, in the case of executing continuous processing of plural workpieces, the cost increases and the frequency of replacement of a grinding wheel increases when the wear of the grinding abrasive stones increases and therefore setting the water amount small is unpreferable.

Furthermore, a grinding apparatus in which biting of grinding abrasive stones is facilitated by setting the water amount of grinding water small at the beginning of processing has also been proposed (for example, refer to Japanese Patent Laid-open No. 2014-124690).

SUMMARY OF THE INVENTION

However, when dulling has occurred due to processing of the previous workpiece, there is a fear that it is difficult for the abrasive stones to bite into the workpiece and the grinding load increases and it is impossible to suppress a rise in the spindle current value even when the water amount of the grinding water is set small at the timing of the start of processing, when the grinding load is liable to be applied at the highest degree.

Thus, an object of the present invention is to provide a grinding method of a workpiece that can realize also reduction in the grinding load while preventing excessive wear of grinding abrasive stones.

In accordance with an aspect of the present invention, there is provided a grinding method of a workpiece that is a grinding method in which the workpiece is thinned to a finished thickness by using a grinding apparatus including a holding table that holds the workpiece, a grinding unit having a spindle on which a grinding wheel on which grinding abrasive stones that grind the workpiece held by the holding table are annularly disposed is mounted and a motor that rotationally drives the spindle, a grinding feed unit that causes the grinding unit to get further away and closer to the holding table, a grinding water supply unit that supplies grinding water to an upper surface of the workpiece held by the holding table in such a manner that the flow rate is adjustable, and a control unit that controls each of the units. The grinding method includes a first grinding step of executing grinding feed of the grinding unit and grinding the workpiece to a predetermined thickness while supplying the grinding water with a first grinding water amount that allows suppression of wear of the grinding abrasive stones and a second grinding step of, after executing the first grinding step, promoting dressing of the grinding abrasive stones to prepare for processing of the next workpiece through executing grinding feed of the grinding unit and grinding the workpiece to the finished thickness while supplying the grinding water with a second grinding water amount that increases wear of the grinding abrasive stones and promotes self-sharpening through reduction relative to the first grinding water amount.

Preferably, the grinding unit includes a rough grinding unit that uses a grinding wheel with a coarse grain size and a finish grinding unit that uses a grinding wheel with a fine grain size and grinds the workpiece ground by the rough grinding unit, and the first grinding step and the second grinding step are executed in the rough grinding unit.

The grinding method of a workpiece according to the present invention provides an effect that reduction in the grinding load can also be realized while excessive wear of the grinding abrasive stones is prevented.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

An embodiment of the present invention will be described in detail below with reference to the drawings. The present invention is not limited by contents described in the following embodiment. Furthermore, what can be easily envisaged by those skilled in the art and what are substantially the same are included in constituent elements described below. Moreover, configurations described below can be combined as appropriate. In addition, various kinds of omission, replacement, or change of a configuration can be carried out without departing from the gist of the present invention.

Figure 1:
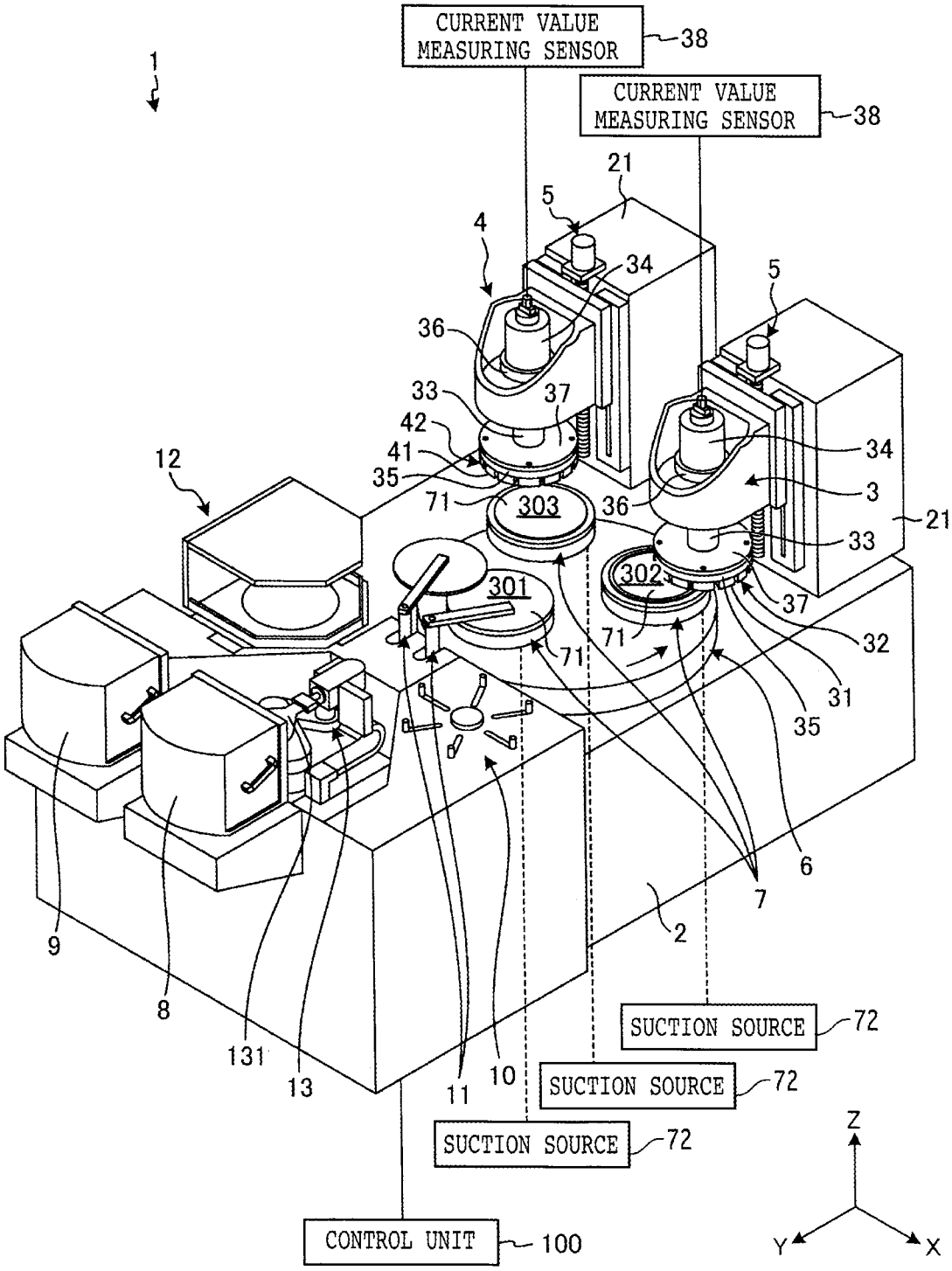
FIG. 1 is a perspective view illustrating a configuration example of a grinding apparatus used in a grinding method of a workpiece according to an embodiment.
Figure 2:
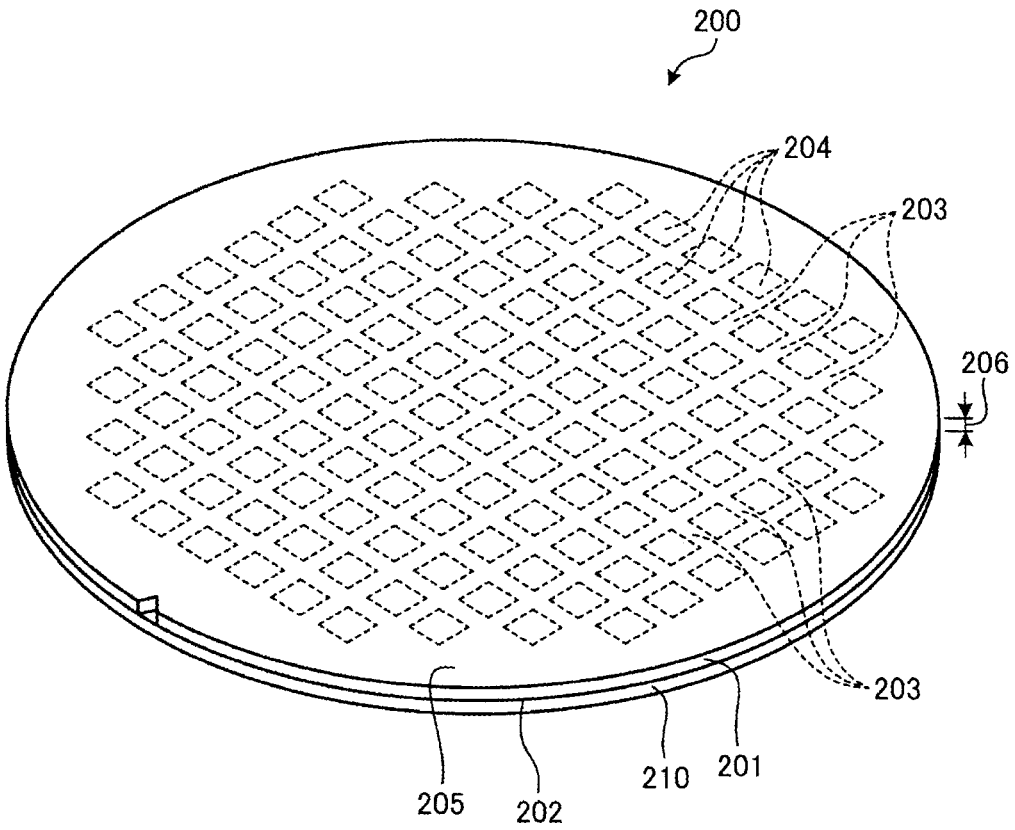
FIG. 2 is a perspective view of a workpiece that is a processing target of the grinding method of a workpiece according to the embodiment.
Figure 3:
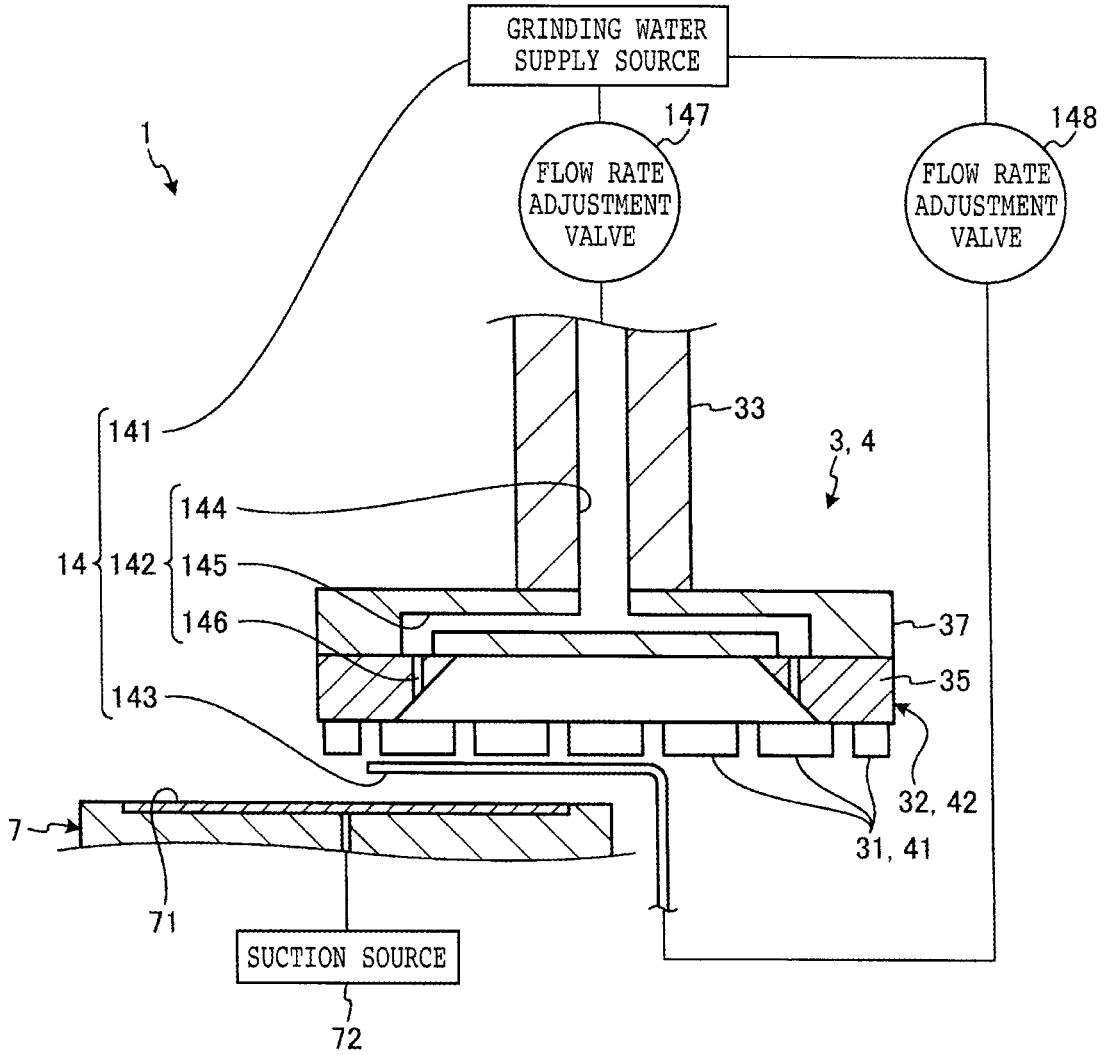
FIG. 3 is a sectional view schematically illustrating the configuration of grinding units, a holding table, and a grinding water supply unit of the grinding apparatus illustrated in FIG. 1.
Figure 4:
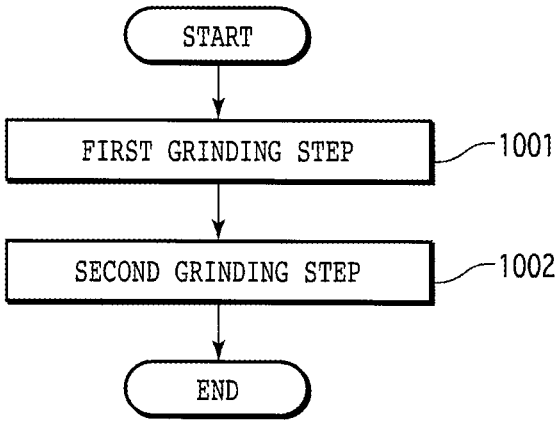
FIG. 4 is a flowchart illustrating the flow of the grinding method of a workpiece according to the embodiment.
Figure 5:
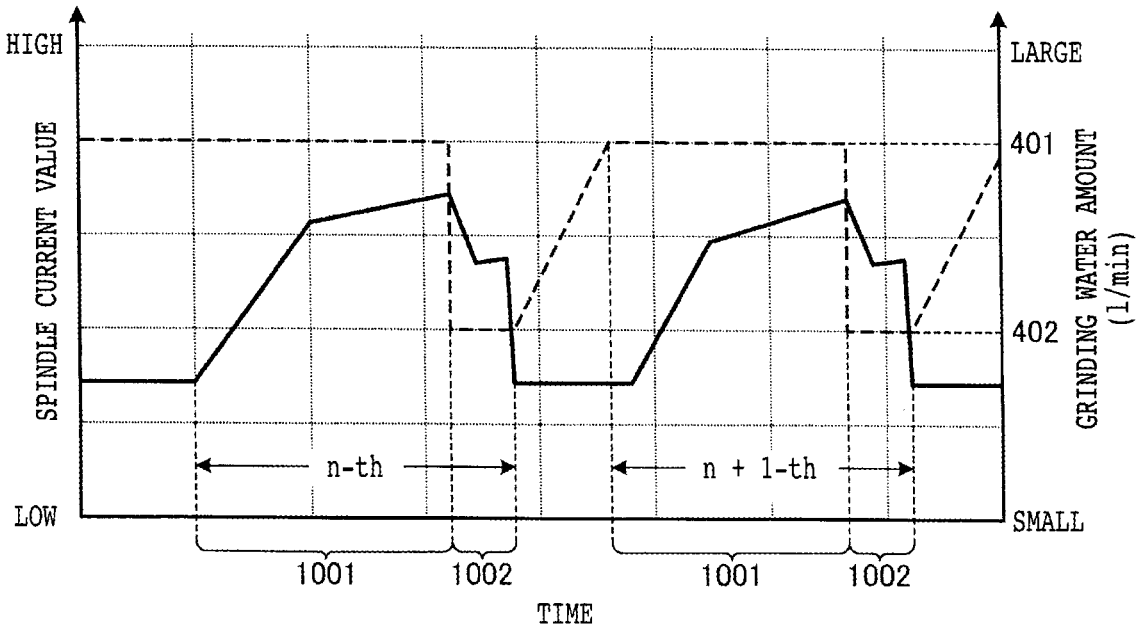
FIG. 5 is a diagram illustrating change in the water amount of grinding water and a spindle current value in the grinding method of a workpiece illustrated in FIG. 4.

A grinding method of a workpiece according to the embodiment of the present invention will be described based on the drawings. FIG. 1 is a perspective view illustrating a configuration example of a grinding apparatus used in the grinding method of a workpiece according to the embodiment. FIG. 2 is a perspective view of a workpiece that is a processing target of the grinding method of a workpiece according to the embodiment. FIG. 3 is a sectional view schematically illustrating the configuration of grinding units, a holding table, and a grinding water supply unit of the grinding apparatus illustrated in FIG. 1. FIG. 4 is a flowchart illustrating the flow of the grinding method of a workpiece according to the embodiment. FIG. 5 is a diagram illustrating change in the water amount of grinding water and a spindle current value in the grinding method of a workpiece illustrated in FIG. 4.

The grinding method of a workpiece according to the embodiment is a grinding method in which a workpiece 200 illustrated in FIG. 2 is thinned by using a grinding apparatus 1 illustrated in FIG. 1. The workpiece 200 that is a processing target of the grinding method of a workpiece according to the embodiment is a wafer such as a circular-plate-shaped semiconductor wafer that employs silicon as a substrate 201 or an optical device wafer that employs sapphire, silicon carbide (SiC), or the like as the substrate 201. In the embodiment, in the workpiece 200, the substrate 201 with a circular disc shape is composed of a material harder than silicon, such as sapphire or silicon carbide (SiC).

In the workpiece 200, as illustrated in FIG. 2, a device 204 is formed in each of plural regions marked out by plural planned dividing lines 203 that intersect (in the embodiment, orthogonally intersect) in a front surface 202 of the substrate 201. For example, the device 204 is a circuit such as an integrated circuit (IC) or large scale integration (LSI), an image sensor of a charge coupled device (CCD), a complementary metal oxide semiconductor (CMOS), or the like, a micro electro mechanical systems (MEMS), or the like. For the workpiece 200, a protective component 210 is stuck to the side of the front surface 202 of the substrate 201, and the side of the front surface 202 is sucked and held by a holding surface 71 with the intermediary of the protective component 210, and grinding processing of a back surface 205 on the back side of the front surface 202 is executed.

Next, the grinding apparatus 1 illustrated in FIG. 1 used in the grinding method of a workpiece according to the embodiment will be described. The grinding apparatus 1 is a processing apparatus that executes grinding processing of the back surface 205 of the workpiece 200. As illustrated in FIG. 2, the grinding apparatus 1 mainly includes an apparatus main body 2, a rough grinding unit 3 (equivalent to the grinding unit), a finish grinding unit 4 (equivalent to the grinding unit), grinding feed units 5, a turntable 6, plural (in the embodiment, three) holding tables 7 set on the turntable 6, cassettes 8 and 9, a position adjustment unit 10, conveying units 11, a cleaning unit 12, a carrying-out/in unit 13, and a control unit 100.

The turntable 6 is a circular-disc-shaped table disposed on the upper surface of the apparatus main body 2 and is disposed rotatably in the horizontal plane and is rotationally driven at a predetermined timing. On the turntable 6, for example, three holding tables 7 are disposed at equal intervals with a phase angle of, for example, 120 degrees. These three holding tables 7 are what have a holding table structure including a vacuum chuck connected to a suction source 72 in the holding surface 7. The workpiece 200 is placed on the holding surface 71 and the workpiece 200 is sucked and held. At the time of grinding, these holding tables 7 are rotationally driven in the horizontal plane by a rotational drive mechanism around the axial center parallel to the vertical direction, i.e. a Z-axis direction. As above, the holding tables 7 are what have the holding surface 71 that holds the workpiece 200 and can rotate around the axial center.

The holding tables 7 are sequentially moved to a carrying-in/out region 301, a rough grinding region 302, a finish grinding region 303, and the carrying-in/out region 301 by rotation of the turntable 6.

Note that the carrying-in/out region 301 is a region in which the workpiece 200 is carried in to and carried out from the holding table 7. The rough grinding region 302 is a region in which rough grinding (equivalent to the grinding) of the workpiece 200 held by the holding table 7 is executed by the rough grinding unit 3. The finish grinding region 303 is a region in which finish grinding (equivalent to the grinding) of the workpiece 200 held by the holding table 7 is executed by the finish grinding unit 4.

The rough grinding unit 3 is a grinding unit on which a grinding wheel 32 for rough grinding on which grinding abrasive stones 31 for rough grinding with which rough grinding of the workpiece 200 held by the holding table 7 is executed are annularly disposed is mounted, and that executes rough grinding of the back surface 205 of the workpiece 200 held by the holding surface 71 of the holding table 7 in the rough grinding region 302. The finish grinding unit 4 is a grinding unit on which a grinding wheel 42 for finish grinding on which grinding abrasive stones 41 for finish grinding with which finish grinding of the workpiece 200 held by the holding table 7 is executed are annularly disposed is mounted, and that executes finish grinding of the back surface 205 of the workpiece 200 held by the holding surface 71 of the holding table 7 in the finish grinding region 303.

Thus, the rough grinding unit 3 is a grinding unit that uses the grinding wheel 32 for rough grinding and the finish grinding unit 4 is a grinding unit that uses the grinding wheel 42 and executes finish grinding of the workpiece 200 for which rough grinding processing has been executed by the rough grinding unit 3. Note that the grinding units 3 and 4 have substantially the same configuration and therefore description will be made with the same part given the same numeral in the following.

As illustrated in FIG. 1, the rough grinding unit 3 and the finish grinding unit 4 have a spindle 33 with the lower end on which the grinding wheel 32 or 42 is mounted and a motor 34 that rotationally drives the spindle 33 around the axial center parallel to the vertical direction (referred to also as the Z-axis direction). As illustrated in FIG. 3, the grinding wheels 32 and 42 have an annular base 35 with a circular annular shape and the plural grinding abrasive stones 31 or 41 fixed to the lower surface of the annular base 35. The grinding abrasive stones 31 and 41 are lined up in the circumferential direction at the outer edge part of the lower surface of the annular base 35. The grinding abrasive stones 31 and 41 are what are made through fixing of abrasive grains by a bond. The abrasive grains of the grinding abrasive stones 31 of the grinding wheel 32 have a more coarse (i.e. larger) grain size than the abrasive grains of the grinding abrasive stones 41 of the grinding wheel 42. The abrasive grains of the grinding abrasive stones 41 of the grinding wheel 42 have a finer grain size than the abrasive grains of the grinding abrasive stones 31 of the grinding wheel 32.

The spindle 33 is housed in a spindle housing 36 rotatably around the axial center parallel to the Z-axis direction perpendicular to the holding surface 71 and is rotated around the axial center by the motor 34 attached to the spindle housing 36. The spindle 33 is formed into a circular column shape and a wheel mount 37 for mounting the grinding wheel 32 or 42 is disposed at the lower end of the spindle 33 as illustrated in FIG. 3. The wheel mount 37 protrudes from the lower end of the spindle 33 in the outer circumferential direction across the whole circumference and the planar shape of the outer circumferential surface is formed into a circular shape. The upper surface of the annular base 35 is overlapped with the lower surface of the wheel mount 37 and the grinding wheel 32 or 42 is fixed by bolts that are not illustrated in the diagram. The spindle 33 and the wheel mount 37 are disposed at positions that are coaxial with each other.

In the grinding units 3 and 4, the spindle 33 and the grinding wheel 32 or 42 are rotated around the axial center by the motor 34. In addition, while grinding water is supplied to the back surface 205 of the workpiece 200 held by the holding table 7 in the grinding region 302 or 303, the grinding abrasive stones 31 or 41 are brought into closer to the holding table 7 at a predetermined feed rate by the grinding feed unit 5. Thereby, rough grinding or finish grinding of the back surface 205 of the workpiece 200 is executed.

Furthermore, in the embodiment, the grinding units 3 and 4 include a current value measuring sensor 38 that measures the current value of a current that flows in the motor 34 when the spindle 33 rotates around the axial center (hereinafter, represented as the spindle current value). The current value measuring sensor 38 outputs a measurement result to the control unit 100. The spindle current value rises when the grinding load of the grinding unit 3 or 4 (it refers to a load that hinders rotation of the grinding wheel 32 or 42) increases, and lowers when the grinding load decreases.

Note that the grinding units 3 and 4 include a grinding water supply unit 14 illustrated in FIG. 3. The grinding water supply unit 14 is a unit that supplies the grinding water to the back surface 205 of the workpiece 200 that is the upper surface of the workpiece held by the holding table 7 in such a manner that the flow rate can be adjusted. As illustrated in FIG. 3, the grinding water supply unit 14 includes a grinding water supply source 141, a grinding water supply flow path 142, and a grinding water supply nozzle 143. The grinding water supply source 141 supplies the grinding water to the grinding water supply flow path 142 and the grinding water supply nozzle 143.

The grinding water supply flow path 142 includes an in-spindle flow path 144 that extends at the center of the spindle 33 along the axial center, an in-mount flow path 145 that communicates with the in-spindle flow path 144 and extends from the in-spindle flow path 144 toward the outer circumference of the wheel mount 37 and is opened in the lower surface of the wheel mount 37, and an in-base flow path 146 that communicates with the in-mount flow path 145 and is opened in the inner circumferential surface of the annular base 35 of the grinding wheel 32 or 42. The in-spindle flow path 144 is a flow path made in the spindle 33. The in-mount flow path 145 is a flow path made in the wheel mount 37. The in-base flow path 146 is a flow path made in the annular base 35. The grinding water supply flow path 142 causes the grinding water supplied from the grinding water supply source 141 to pass through the flow paths 144, 145, and 146 sequentially and supplies the grinding water to the inner circumferential surface of the annular base 35 of the grinding wheel 32 or 42. Thereby, the grinding water supply flow path 142 supplies the grinding water to the grinding abrasive stones 31 or 41 that grind the workpiece 200 and the workpiece 200.

The grinding water supply nozzle 143 is disposed below the lower surface of the grinding wheel 32 or 42 of the grinding unit 3 or 4 and is disposed inside the plural grinding abrasive stones 31 or 41 of the grinding wheel 32 or 42 of the grinding unit 3 or 4 in grinding processing. The grinding water supply nozzle 143 is disposed below the lower surface of the grinding wheel 32 or 42 of the grinding unit 3 or 4 and extends from the center of the grinding wheel 32 or 42 of the grinding unit 3 or 4 in grinding processing toward the center of the holding surface 71 of the holding table 7 located at the processing position (that is, the grinding abrasive stone 31 or 41 located at the processing position), and supplies the grinding water supplied from the grinding water supply source 141 to the grinding abrasive stone 31 or 41 located at the processing position. Note that the grinding abrasive stone 31 or 41 located at the processing position is the grinding abrasive stone 31 or 41 located over the center of the holding surface 71 of the holding table 7 in the plural grinding abrasive stones 31 or 41 that rotate around the axial center.

Furthermore, in the embodiment, the grinding water supply unit 14 includes a flow rate adjustment valve 147 that controls the flow rate of the grinding water (equivalent to the grinding water amount) supplied to the grinding water supply flow path 142 and a flow rate adjustment valve 148 that controls the flow rate of the grinding water supplied to the grinding water supply nozzle 143.

The grinding feed units 5 are units that move the grinding units 3 and 4 in the Z-axis direction to cause the grinding units 3 and 4 to get further away from and closer to the holding table 7. In the embodiment, the grinding feed units 5 are disposed on upright-disposed columns 21 disposed upright from one end part of the apparatus main body 2 in a Y-axis direction parallel to the horizontal direction. The grinding feed units 5 include a well-known ball screw disposed rotatably around the axial center, a well-known motor that rotates the ball screw around the axial center, and a well-known guide rail that supports the spindle housing 36 of each grinding unit 3 or 4 movably in the Z-axis direction.

Incidentally, in the embodiment, in the rough grinding unit 3 and the finish grinding unit 4, the axial center that is the rotation center of the grinding wheel 32 or 42 and the axial center that is the rotation center of the holding table 7 are disposed in parallel at an interval from each other in the horizontal direction and the grinding abrasive stones 31 or 41 pass over the center of the back surface 205 of the workpiece 200 held by the holding table 7.

Cassettes 8 and 9 are housing containers that have plural slots and are for housing the workpieces 200. The cassettes 8 and 9 house the workpieces 200 before and after grinding processing. Furthermore, the position adjustment unit 10 is a table for allowing the workpiece 200 taken out from the cassette 8 or 9 to be temporarily placed thereon and executing center position adjustment of the workpiece 200.

Two conveying units 11 are disposed. The two conveying units 11 have a suction adhesion pad that causes suction adhesion of the workpiece 200. One conveying unit 11 holds, by suction adhesion, the workpiece 200 before grinding processing for which position adjustment has been executed by the position adjustment unit 10 and carries in the workpiece 200 onto the holding table 7 located in the carrying-in/out region 301. The other conveying unit 11 holds, by suction adhesion, the workpiece 200 after grinding processing held on the holding table 7 located in the carrying-in/out region 301 and carries out the workpiece 200 to the cleaning unit 12.

The cleaning unit 12 cleans the workpiece 200 after grinding and removes contamination such as grinding dust that adheres to the ground back surface 205. The carrying-out/in unit 13 is a robot pick including a U-shaped hand 131, for example, and holds the workpiece 200 by suction adhesion and conveys it by the U-shaped hand 131. Specifically, the carrying-out/in unit 13 takes out the workpiece 200 before grinding processing from the cassette 8 or 9 and carries out the workpiece 200 to the position adjustment unit 10. In addition, the carrying-out/in unit 13 takes out the workpiece 200 after grinding processing from the cleaning unit 12 and carries in the workpiece 200 to the cassette 8 or 9.

Furthermore, the grinding apparatus 1 includes a thickness measuring instrument that is not illustrated in the diagram and measures the thickness of the workpieces 200 held by the holding tables 7 in the rough grinding region 302 and the finish grinding region 303. The thickness measuring instrument outputs a measurement result to the control unit 100.

The control unit 100 is what controls each of the above-described respective constituent units that configure the grinding apparatus 1. That is, the control unit 100 causes the grinding apparatus 1 to execute grinding processing operation for the workpiece 200. The control unit 100 is a computer having a calculation processing device having a microprocessor such as a central processing unit (CPU), a storing device having a memory such as a read only memory (ROM) or random access memory (RAM), and an input-output interface device.

The calculation processing device of the control unit 100 executes calculation processing according to a computer program stored in the storing device and outputs a control signal for controlling the grinding apparatus 1 to the above-described constituent elements of the grinding apparatus 1 through the input-output interface device. Furthermore, the control unit 100 is connected to a display unit configured by a liquid crystal display device or the like that displays the state of processing operation, an image, and so forth and an input unit used when an operator registers information on the contents of processing or the like. The input unit is configured by at least one of a touch panel disposed in the display unit, a keyboard, and so forth.

The grinding apparatus 1 with the above-described configuration executes processing operation to thin the workpiece 200 through sequentially executing rough grinding processing and finish grinding processing for the workpiece 200 by control of the respective constituent units by the control unit 100. In the embodiment, the cassettes 8 and 9 that house the workpieces 200 for which the protective component 210 is stuck to the front surface 202 in such a manner that the protective component 210 is oriented downward are set on the apparatus main body 2 by an operator. Then, a processing condition is registered in the control unit 100 and the control unit 100 accepts an instruction to start processing operation from the operator. Thereupon, the grinding apparatus 1 starts the processing operation.

In the processing operation, the grinding apparatus 1 rotates the spindles 33 of the respective grinding units 3 and 4 around the axial center at a rotation speed defined in the processing condition and causes the carrying-out/in unit 13 to take out one workpiece 200 from the cassette 8 and carry out the workpiece 200 to the position adjustment unit 10. The grinding apparatus 1 causes the position adjustment unit 10 to execute center position adjustment of the workpiece 200 and causes the conveying unit 11 to carry in the side of the front surface 202 of the workpiece 200 for which the position adjustment has been executed onto the holding table 7 located in the carrying-in/out region 301. At this time, the workpiece 200 carried in to the holding table 7 is positioned to the position coaxial with the holding table 7.

In the processing operation, the grinding apparatus 1 sucks and holds the side of the front surface 202 of the workpiece 200 on the holding table 7 in the carrying-in/out region 301 with the interposition of the protective component 210 and rotates the turntable 6 to move the holding table 7 that holds the workpiece 200 in the carrying-in/out region 301 to the rough grinding region 302. In the processing operation, the grinding apparatus 1 executes rough grinding processing of the workpiece 200 by the rough grinding unit 3 with rotation of the holding table 7 around the axial center while supplying the grinding water and rotates the turntable 6 to move the holding table 7 that holds the workpiece 200 after the rough grinding processing to the finish grinding region 303. The grinding apparatus 1 executes finish grinding processing of the workpiece 200 by the finish grinding unit 4 with rotation of the holding table 7 around the axial center while supplying the grinding water and rotates the turntable 6 to move, to the carrying-in/out region 301, the holding table 7 that holds the workpiece 200 after the finish grinding processing and whose rotation around the axial center has stopped.

In the processing operation, the grinding apparatus 1 conveys the workpiece 200 after the finish grinding processing from the holding table 7 in the carrying-in/out region 301 to the cleaning unit 12 and cleans the workpiece 200 by the cleaning unit 12 and thereafter houses the workpiece 200 in the cassette 8 or 9. In the processing operation, every time the turntable 6 rotates, the grinding apparatus 1 carries in the workpiece 200 to the holding table 7 in the carrying-in/out region 301 that does not hold the workpiece 200 after the finish grinding processing and conveys the workpiece 200 from the holding table 7 in the carrying-in/out region 301 that holds the workpiece 200 after the finish grinding processing to the cleaning unit 12 and thereafter carries in the workpiece 200 before the grinding processing. When having executed the rough grinding processing and the finish grinding processing for all workpieces 200 in the cassettes 8 and 9, the grinding apparatus 1 ends the processing operation. Next, the grinding method of a workpiece will be described.

(Grinding Method of Workpiece)

The grinding method of a workpiece according to the embodiment is a grinding method in which the workpiece 200 is thinned to a predetermined finished thickness 206 (illustrated in FIG. 2) by using the above-described grinding apparatus 1, and is executed in the rough grinding unit 3 in the embodiment. Thus, in the embodiment, the predetermined finished thickness 206 is the thickness of the workpiece 200 after the rough grinding processing by the rough grinding unit 3 and does not necessarily correspond with the thickness of the workpiece 200 after the finish grinding processing.

As illustrated in FIG. 4, the grinding method of a workpiece according to the embodiment has a first grinding step 1001 and a second grinding step 1002. That is, in the embodiment, the first grinding step 1001 and the second grinding step 1002 are executed in the rough grinding unit 3.

(First Grinding Step)

The first grinding step 1001 is a step of executing grinding feed of the rough grinding unit 3 and grinding the workpiece 200 to a predetermined thickness while supplying, to the grinding abrasive stones 31, grinding water with a first grinding water amount 401 (illustrated in FIG. 5) that is a flow rate that can suppress wear of the grinding abrasive stones 31. Note that the predetermined thickness is a thickness thicker than the finished thickness 206 and is defined as appropriate according to the kind of workpiece 200, the kind of grinding abrasive stones 31 of the rough grinding unit 3, and so forth.

While supplying the grinding water with the first grinding water amount 401 from the grinding water supply unit 14 to the grinding abrasive stones 31 of the grinding wheel 32 of the rough grinding unit 3, the grinding apparatus 1 brings the rough grinding unit 3 closer to the workpiece 200 held by the holding table 7 in the rough grinding region 302 by the grinding feed unit 5. Then, the grinding abrasive stones 31 of the rough grinding unit 3 get contact with the workpiece 200 and the rough grinding processing and the first grinding step 1001 are started, so that the workpiece 200 is gradually thinned. Note that the first grinding water amount 401 of the first grinding step 1001 is the sum of the flow rate that is the grinding water amount of the grinding water supplied to the grinding water supply flow path 142 and the flow rate that is the grinding water amount of the grinding water supplied to the grinding water supply nozzle 143. Furthermore, the first grinding water amount 401 is equivalent to a water amount (flow rate) when the rough grinding unit 3 conventionally used executes rough grinding processing of the workpiece 200, i.e. when grinding apparatus conventionally used executes grinding processing of the workpiece 200.

In this manner, in the first grinding step 1001, wear of the grinding abrasive stones 31 of the rough grinding unit 3 can be suppressed by supplying the grinding water with the first grinding water amount 401 equivalent to the conventional grinding water amount from the grinding water supply unit 14 to the grinding abrasive stones 31 of the grinding wheel 32 of the rough grinding unit 3. As above, the first grinding water amount 401 that can suppress wear of the grinding abrasive stones 31 is a water amount (flow rate) equivalent to that when the rough grinding unit 3 conventionally used executes rough grinding processing of the workpiece 200, i.e. when a grinding apparatus conventionally used executes grinding processing of the workpiece 200.

Note that the abscissa axis of FIG. 5 indicates the time. The right ordinate axis indicates the grinding water amount of the grinding water supplied to the rough grinding unit 3. The left ordinate axis indicates the spindle current value of the rough grinding unit 3. Furthermore, a dotted line in FIG. 5 illustrates change in the grinding water amount of the grinding water supplied to the rough grinding unit 3. A solid line in FIG. 5 illustrates change in the spindle current value of the rough grinding unit 3.

In the embodiment, in the first grinding step 1001, the grinding feed rate of the rough grinding unit 3 brought closer to the holding table 7 by the grinding feed unit 5 is lowered in a stepwise manner according to the thickness of the workpiece 200. In the embodiment, in the first grinding step 1001, the grinding feed rate of the rough grinding unit 3 by the grinding feed unit 5 is lowered at three stages. However, in the present invention, the stages at which the grinding feed rate is lowered are not limited to three stages.

In the first grinding step 1001, as illustrated in FIG. 5, in the grinding apparatus 1, dulling gradually occurs because of the state in which self-sharpening is not promoted due to suppression of wear of the bond of the grinding abrasive stones 31 of the rough grinding unit 3, the influence of grinding dust, and so forth and the spindle current value of the rough grinding unit 3 gradually rises. In the first grinding step 1001, as illustrated in FIG. 5, the grinding apparatus 1 keeps the grinding water amount at the first grinding water amount 401 and thins the workpiece 200 to the predetermined thickness.

(Second Grinding Step)

The second grinding step 1002 is a step of, after executing the first grinding step 1001, promoting dressing of the grinding abrasive stones 31 to prepare for rough grinding processing of the next workpiece 200 through executing grinding feed of the rough grinding unit 3 and executing rough grinding processing of the workpiece 200 to the finished thickness 206 while supplying the grinding water with a second grinding water amount 402 that increases wear of the grinding abrasive stones 31 and promotes self-sharpening through reducing the grinding water amount relative to the first grinding water amount 401.

In the second grinding step 1002, the grinding apparatus 1 lowers the grinding feed rate of the rough grinding unit 3 by the grinding feed unit 5 relative to the grinding feed rate of the first grinding step 1001 and, as illustrated in FIG. 5, controls the flow rate adjustment valves 147 and 148 to reduce the water amount of the grinding water supplied to the grinding abrasive stones 31 of the grinding wheel 32 of the rough grinding unit 3 by the grinding water supply unit 14 to the second grinding water amount 402 lower than the first grinding water amount 401. In this case, self-sharpening in which the bond of the grinding abrasive stones 31 of the rough grinding unit 3 wears and abrasive grains drop off from the bond is promoted. In the second grinding step 1002, the grinding abrasive stones 31 of the rough grinding unit 3 in which dulling has been being caused due to grinding dust and so forth in the first grinding step 1001 are subjected to dressing to allow rough grinding processing by new abrasive grains due to the promotion of the self-sharpening.

Thus, in the second grinding step 1002, in the grinding apparatus 1, the grinding load lowers relative to that in the first grinding step 1001 and the spindle current value lowers as illustrated in FIG. 5 because the self-sharpening of the grinding abrasive stones 31 of the rough grinding unit 3 is promoted and dressing is executed. In the second grinding step 1002, when having thinned the workpiece 200 to the finished thickness 206, the grinding apparatus 1 stops the grinding feed of the rough grinding unit 3 by the grinding feed unit 5. Thereafter, the grinding apparatus 1 separates the rough grinding unit 3 from the holding table 7 by the grinding feed unit 5 and ends the second grinding step 1002 to end the rough grinding processing of the workpiece 200.

Then, the grinding apparatus 1 sequentially executes the first grinding step 1001 and the second grinding step 1002 in the rough grinding unit 3 for the next workpiece 200 (hereinafter, referred to as the n+1-th workpiece, n is a natural number) held by the holding table 7 positioned in the rough grinding region 302 next through rotation of the turntable 6. At this time, because dressing of the grinding abrasive stones 31 of the rough grinding unit 3 is executed when the second grinding step 1002 is executed for the previous workpiece 200 (hereinafter, referred to as the n-th workpiece), when the first grinding step 1001 is executed for the n+1-th workpiece 200, the grinding abrasive stones 31 bite into the workpiece 200 from immediately after the start of the first grinding step 1001 and the grinding load does not suddenly rise. Thus, as illustrated in FIG. 5, the spindle current value does not represent a sharp rise temporarily but gradually rises similarly to when the n-th workpiece 200 is ground. FIG. 5 illustrates the case of n=1.

As above, in the grinding method of a workpiece according to the embodiment, the grinding water amount of the second grinding step 1002 in the latter half of grinding processing of the workpiece 200 is set to the second grinding water amount 402 arising from reduction relative to the first grinding water amount 401 of the first grinding step 1001 and self-sharpening of the grinding abrasive stones 31 is promoted. Thus, in the grinding method of a workpiece according to the embodiment, the rough grinding processing of the next workpiece 200 can be started in the state in which dressing has been sufficiently executed and it becomes easier for the grinding abrasive stones 31 to bite into the workpiece 200 at the time of the start of rough grinding processing of the n+1-th workpiece 200. Thus, the grinding load at the time of the start of the rough grinding processing, when the grinding load of the n+1-th workpiece 200 is readily applied, can be suppressed. This can prevent a rise in the spindle current value at the time of the start of the rough grinding processing of the n+1-th workpiece 200.

Furthermore, in the grinding method of a workpiece according to the embodiment, the grinding water amount of the first grinding step 1001 in the former half of grinding processing of the workpiece 200 is set to the first grinding water amount 401 that is equivalent to the conventional grinding water amount and is higher than the second grinding water amount 402. Therefore, wear of the grinding abrasive stones 31 in the first grinding step 1001 is suppressed and the grinding water amount is reduced to the second grinding water amount 402 to increase the wear and promote self-sharpening in the latter half, in which dulling progresses. Due to this, the grinding method of a workpiece according to the embodiment can reduce the grinding load while preventing excessive wear of the grinding abrasive stones 31.

Furthermore, the grinding method of a workpiece according to the embodiment uses the grinding apparatus 1 that executes rough grinding processing and finish grinding processing. Therefore, the water amount of the grinding water is reduced to promote self-sharpening in the second grinding step 1002 of the rough grinding unit 3. In the grinding method of a workpiece according to the embodiment, by executing grinding with use of the grinding abrasive stones 31 in which self-sharpening is promoted in the second grinding step 1002, the back surface 205 that is the ground surface of the workpiece 200 after the rough grinding processing by the rough grinding unit 3 can dare to be roughened (same meaning as making scratches to increase the surface roughness) at a higher degree than in the case in which the grinding water amount is kept constant from the start of the grinding to the end and in a conventional method in which grinding is executed with the grinding water amount increased in the latter half of the grinding relative to in the former half. Due to this, because the grinding method of a workpiece according to the embodiment uses the grinding apparatus 1 that executes rough grinding processing and finish grinding processing, the grinding abrasive stones 41 of the grinding wheel 42 for finish grinding readily bite into the workpiece 200 due to concavities and convexities of the back surface 205 of the workpiece 200 when grinding is executed by the grinding wheel 42 for finish grinding with a finer grain size of abrasive grains at the time of the finish grinding processing. Furthermore, wear is also promoted and grinding processing with suppression of the grinding load can be implemented even with the grinding wheel 42 for finish grinding, in which the grinding abrasive stones 41 bite into the workpiece 200 less readily.

As a result, the grinding method of a workpiece according to the embodiment provides an effect that reduction in the grinding load can also be realized while excessive wear of the grinding abrasive stones 31 is prevented.

Moreover, because the grinding method of a workpiece according to the embodiment uses the grinding apparatus 1 that executes rough grinding processing and finish grinding processing, the surface roughness of the back surface 205 of the workpiece 200 can be set low by the finish grinding processing even when the back surface 205 of the workpiece 200 is roughened by the rough grinding unit 3. Therefore, the processing quality of the workpiece 200 can also be kept high while the grinding load is reduced.

Figure 6:
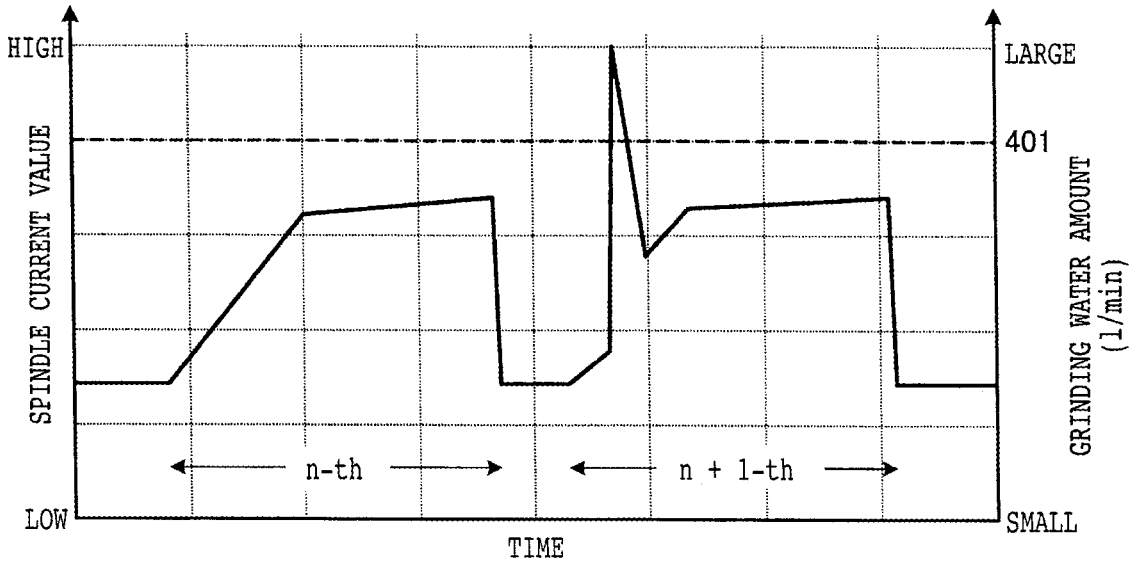
FIG.6 PRIOR ART
FIG. 6 is a diagram illustrating change in the water amount of grinding water and the spindle current value in comparative example 1.
Figure 7:
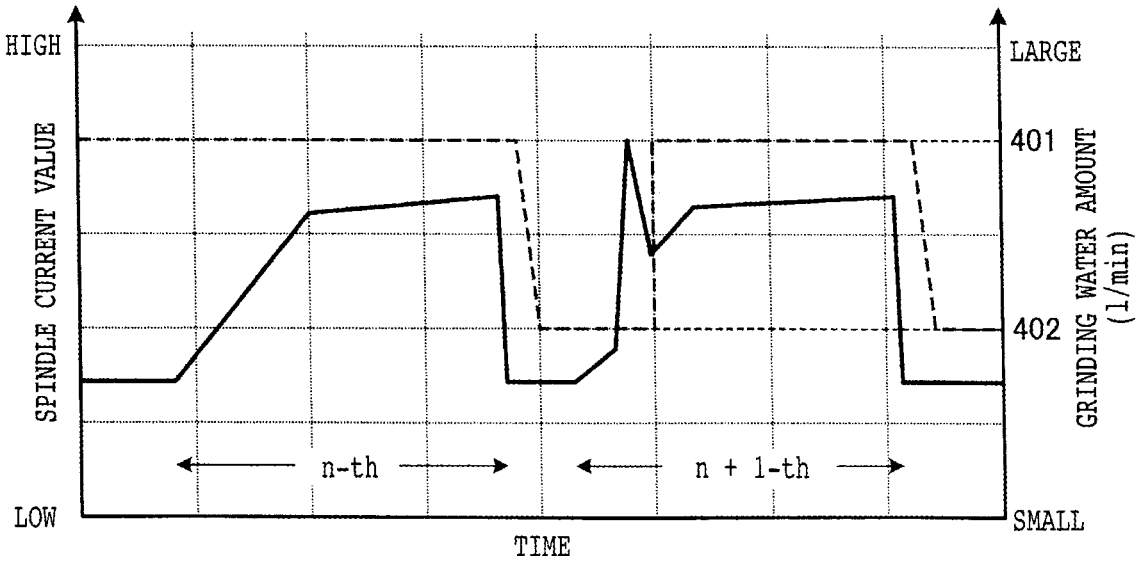
FIG.7 PRIOR ART
FIG. 7 is a diagram illustrating change in the water amount of the grinding water and the spindle current value in comparative example 2.

Next, the assignee of the present invention confirmed effects of the grinding method of a workpiece according to the embodiment. In the confirmation, in comparative example 1 illustrated in FIG. 6 and comparative example 2 illustrated in FIG. 7, the spindle current value when rough grinding processing of the n-th workpiece 200 and the n+1-th workpiece 200 was executed by the rough grinding unit 3 was measured. Furthermore, in the confirmation, n=1 was set. Note that FIG. 6 is a diagram illustrating change in the water amount of grinding water and the spindle current value in comparative example 1. FIG. 7 is a diagram illustrating change in the water amount of the grinding water and the spindle current value in comparative example 2.

Incidentally, in FIG. 6 and FIG. 7, similarly to FIG. 5, the abscissa axis indicates the time, and the right ordinate axis indicates the grinding water amount of the grinding water supplied to the rough grinding unit 3, and the left ordinate axis indicates the spindle current value of the rough grinding unit 3. Furthermore, in FIG. 6 and FIG. 7, a dotted line represents change in the grinding water amount of the grinding water supplied to the rough grinding unit 3 and a solid line represents change in the spindle current value of the rough grinding unit 3.

In comparative example 1, regarding which the spindle current value is illustrated in FIG. 6, the grinding water amount was kept at the first grinding water amount 401 at the time of the rough grinding processing by the rough grinding unit 3 and the other conditions were set identical to those of the embodiment (that is, the grinding water amount was neither increased nor decreased from the first grinding water amount 401 from immediately after the processing start of the rough grinding processing to the time of the processing end). In comparative example 2, regarding which the spindle current value is illustrated in FIG. 7, the grinding water amount immediately after the start of the rough grinding processing of the n+1-th workpiece 200 was set to the second grinding water amount 402 and thereafter the grinding water amount was kept at the first grinding water amount 401 and the other conditions were set identical to those of the embodiment (corresponding to the method described in the above-described Japanese Patent Laid-open No. 2014-124690) (that is, form in which the grinding water amount immediately after the processing start of the rough grinding processing was set smaller than that in the latter half of the rough grinding processing and the grinding water amount was increased in the latter half of the rough grinding processing relative to that in the former half of the processing).

According to FIG. 6, in comparative example 1, because the grinding water amount was kept at the first grinding water amount 401 that suppressed wear of the grinding abrasive stones 31, loading of the grinding abrasive stones 31 occurred and the spindle current value temporarily rose at the time of the start of the rough grinding processing of the n+1-th workpiece 200. Furthermore, according to FIG. 7, in comparative example 2, in the latter half of the rough grinding processing, the grinding water amount was changed to the second grinding water amount 402 arising from reduction relative to the first grinding water amount 401 used in the former half of the processing and wear of the grinding abrasive stones 31 was suppressed. Therefore, in the state in which the grinding abrasive stones 31 involved dulling, the timing of the processing start, when the grinding load was applied at the highest degree with respect to the next workpiece 200, came. Thus, the grinding load further rose and the spindle current value temporarily rose at the time of the start of the rough grinding processing of the n+1-th workpiece 200. Therefore, according to FIG. 6 and FIG. 7, it became clear that the grinding load temporarily rose at the time of the start of the rough grinding processing of the n+1-th workpiece 200 in comparative example 1 and comparative example 2. The temporary sudden rose in the grinding load is liable to give scratches and damage to the workpiece 200 as well as the grinding abrasive stones 31 and therefore is unpreferable.

It is obvious that, in contrast to such comparative example 1 and comparative example 2, in the embodiment, the spindle current value does not temporarily rise at the time of the start of the rough grinding processing of the n+1-th workpiece 200 as illustrated in FIG. 5 and the grinding load does not temporarily rise. Therefore, it becomes clear that the grinding load at the time of the start of the rough grinding processing of the n+1-th workpiece 200 can be suppressed by setting the grinding water amount of the second grinding step 1002 in the latter half of grinding processing of the workpiece 200 to the second grinding water amount 402 arising from reduction relative to the first grinding water amount 401 of the first grinding step 1001 and promoting self-sharpening of the grinding abrasive stones 31.

Note that the present invention is not limited to the above-described embodiment. That is, the present invention can be carried out with various modifications without departing from the gist of the present invention. Incidentally, in the embodiment, the grinding water supply unit 14 includes the flow rate adjustment valve 147 that controls the flow rate (equivalent to the grinding water amount) of the grinding water supplied to the grinding water supply flow path 142 and the flow rate adjustment valve 148 that controls the flow rate of the grinding water supplied to the grinding water supply nozzle 143. However, it suffices that the grinding water supply unit 14 includes at least either the set of the grinding water supply flow path 142 and the flow rate adjustment valve 147 or the set of the grinding water supply nozzle 143 and the flow rate adjustment valve 148. Furthermore, when the grinding water amount is changed from the first grinding water amount 401 to the second grinding water amount 402, both of the flow rate adjustment valve 147 and the flow rate adjustment valve 148 are adjusted in the embodiment. However, only either one may be adjusted.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A workpiece grinding method in which a workpiece is thinned to a finished thickness by using a grinding apparatus including a holding table that holds the workpiece, a grinding unit having a spindle on which a grinding wheel, on which grinding abrasive stones that grind the workpiece held by the holding table are annularly disposed, is mounted and a motor that rotationally drives the spindle, a grinding feed unit that causes the grinding unit to get further away and closer to the holding table, a grinding water supply unit that supplies grinding water to an upper surface of the workpiece held by the holding table in such a manner that a flow rate is adjustable, and a control unit that controls each of the units, the grinding method comprising:

a first grinding step of executing grinding feed of the grinding unit at a first grinding feed rate and grinding the workpiece to a predetermined thickness while supplying the grinding water with a first constant grinding water amount that allows suppression of wear of the grinding abrasive stones; and a second grinding step of, upon reaching the predetermined thickness of the workpiece in the first grinding step, changing the grinding feed of the grinding unit to a second grinding feed rate lower than the first grinding feed rate, changing the supply of the grinding water to a second constant grinding water amount reduced relative to the first grinding water amount, and grinding the workpiece to the finished thickness while supplying the grinding water at the second constant grinding water amount, wherein the second grinding step increases wear and promotes self-sharpening of the grinding abrasive stones.

2. The grinding method of a workpiece according to claim 1, wherein the grinding abrasive stones on the grinding wheel include abrasive grains with a coarse grain size, and the grinding apparatus further includes a finish grinding unit that uses a finish grinding wheel with a fine grain size and grinds the workpiece ground by the grinding unit, and the first grinding step and the second grinding step are executed in the grinding unit.

3. The grinding method of a workpiece according to claim 1, wherein the grinding water is supplied to the upper surface of the workpiece through an in-spindle flow path that extends along an axial center of the spindle, an in-mount flow path that communicates with the in-spindle flow path and extends from the in-spindle flow path toward an outer circumference of a wheel mount on which the grinding wheel is mounted and is opened in a lower surface of the wheel mount, and an in-base flow path that communicates with the in-mount flow path and is opened in an inner circumferential surface of an annular base of the grinding wheel.

4. The grinding method of a workpiece according to claim 3, wherein the grinding water is further supplied to the upper surface of the workpiece through a grinding water supply nozzle disposed below a lower surface of, and inside the grinding abrasive stones annularly disposed on, the grinding wheel.

5. The grinding method of a workpiece according to claim 4, wherein the first grinding water amount is a sum of a flow rate of the grinding water supplied to the in-spindle flow path, the in-mount flow path and the in-base flow path, and the grinding water supplied to the grinding water supply nozzle.

* * * * *